US009161579B1

(12) United States Patent
Johnson

(10) Patent No.: US 9,161,579 B1
(45) Date of Patent: Oct. 20, 2015

(54) PUNCTURE-RESISTANT GLOVE

(71) Applicant: Brant Johnson, Clinton, MS (US)

(72) Inventor: Brant Johnson, Clinton, MS (US)

( * ) Notice: Subject to any disclaimer, the term of this patent is extended or adjusted under 35 U.S.C. 154(b) by 120 days.

(21) Appl. No.: 13/785,408

(22) Filed: Mar. 5, 2013

(51) Int. Cl.
*A41D 19/015* (2006.01)

(52) U.S. Cl.
CPC ..... *A41D 19/01505* (2013.01)

(58) Field of Classification Search
CPC ..... A41D 19/01505
USPC ..... 2/16, 20, 160, 163, 161.1, 161.6
See application file for complete search history.

(56) References Cited

U.S. PATENT DOCUMENTS

| | | | | | |
|---|---|---|---|---|---|
| 3,273,165 | A * | 9/1966 | Sperandeo | ..... | 2/169 |
| 4,051,553 | A * | 10/1977 | Howard | ..... | 2/20 |
| 5,070,543 | A | 12/1991 | Beck | | |
| 5,564,127 | A | 10/1996 | Manne | | |
| 6,178,554 | B1 | 1/2001 | Pake et al. | | |
| 6,415,446 | B1 * | 7/2002 | McLean et al. | ..... | 2/161.6 |
| 6,457,182 | B1 | 10/2002 | Szczesuil et al. | | |
| 6,928,658 | B2 * | 8/2005 | Taira et al. | ..... | 2/161.6 |
| 7,788,737 | B2 * | 9/2010 | Baker et al. | ..... | 2/161.6 |
| 2007/0083968 | A1 | 4/2007 | Stokes | | |
| 2009/0007313 | A1 | 1/2009 | Boorsma et al. | | |
| 2009/0126074 | A1 * | 5/2009 | Mattesky | ..... | 2/161.8 |
| 2010/0325779 | A1 * | 12/2010 | Matsunobu et al. | ..... | 2/167 |
| 2011/0179551 | A1 * | 7/2011 | VanErmen | ..... | 2/161.6 |

* cited by examiner

*Primary Examiner* — Katherine Moran
(74) *Attorney, Agent, or Firm* — R. Keith Harrison

(57) ABSTRACT

A puncture-resistant glove includes a glove body having a hand portion with an index finger, a middle finger, a ring finger, a little finger and a thumb and a puncture-resistant area generally covering the hand portion, the thumb and the index finger.

9 Claims, 1 Drawing Sheet

PUNCTURE-RESISTANT GLOVE

FIELD

The disclosure generally relates to gloves. More particularly, the disclosure relates to acupuncture-resistant glove which is particularly suitable for protecting the hand of a wearer from being inadvertently cut or punctured while shucking oysters.

BACKGROUND

Among many seafood lovers, oysters are a favorite and can be prepared in a variety of ways. Oysters are commonly prepared for consumption as oysters on the half shell (in which raw oysters are presented to a consumer with the bottom half of the oyster shell) or as Oysters Rockefeller or Oysters Bienville (in which oysters on the half shell are topped with various ingredients and then baked or broiled). Alternatively, oysters can be completely removed from the shell and eaten fried, baked, broiled or raw. Prior to consumption, oysters are partially or completely removed from the shell using a technique which is commonly known as "shucking".

A common oyster shucking technique involves holding an oyster firmly in one hand and a knife in the other hand. The blade of the knife is initially inserted between the top and bottom portions of the oyster shell next to the hinge which connects the top and bottom shell portions. The top shell portion is cut from the bottom shell portion as the inserted knife is moved from one side to the other side of the hinge. The top shell portion is then separated from the bottom shell portion and discarded, after which the oyster may then be cut free from the bottom shell portion. In preparation of oysters on the half shell, the oyster is typically placed back on the bottom shell portion and presented to a consumer in a raw or uncooked condition. In preparation of Oysters Rockefeller or Oysters Bienville, the oysters are typically placed back on the bottom shell portion and seasoned and baked. In other preparation methods, both the top and bottom shell portions may be discarded after the oyster is removed from the bottom shell portion.

Oyster shucking typically requires that a person apply sufficient force against the handle of the shucking knife to completely cut the top shell portion from the bottom shell portion of the oyster shell. One of the common drawbacks of shucking oysters is the tendency for the shucking knife to inadvertently slip out of place and cut, puncture or even impale the hand which holds the oyster as the shell portions are separated from each other. Moreover, a broken or fragmented oyster shell frequently has sharp edges which have a tendency to cut either hand of the person. Therefore, it is strongly recommended that persons who shuck oysters wear a puncture-resistant glove on the hand which holds the oyster as well as on the hand which holds the knife during shucking. Additionally, the oysters are typically maintained under ice cold conditions for serving to customers after they are shucked. Conventional puncture-resistant gloves typically do not thermally insulate the hands from the cold conditions which prevail during shucking. The coldness may numb the hands of the person, increasing the safety hazard of the shucking operation.

Accordingly, puncture-resistant and cut-resistant gloves which are particularly suitable for protecting the hands of a wearer from being inadvertently cut, punctured or impaled while shucking oysters are needed.

SUMMARY

The disclosure is generally directed to puncture-resistant gloves which are particularly suitable for protecting the hands of a wearer from being inadvertently cut, punctured or impaled while shucking oysters. An illustrative embodiment of the puncture-resistant glove includes a glove body having a hand portion with a palm side surface, an index finger, a middle finger, a ring finger, a little finger and a thumb and a puncture-resistant area generally covering at least the palm side surface, the thumb and the index finger.

BRIEF DESCRIPTION OF THE DRAWINGS

The disclosure will now be made, by way of example, with reference to the accompanying drawings, in which.

DETAILED DESCRIPTION

Figures 1, 2, 3, 4, 5:
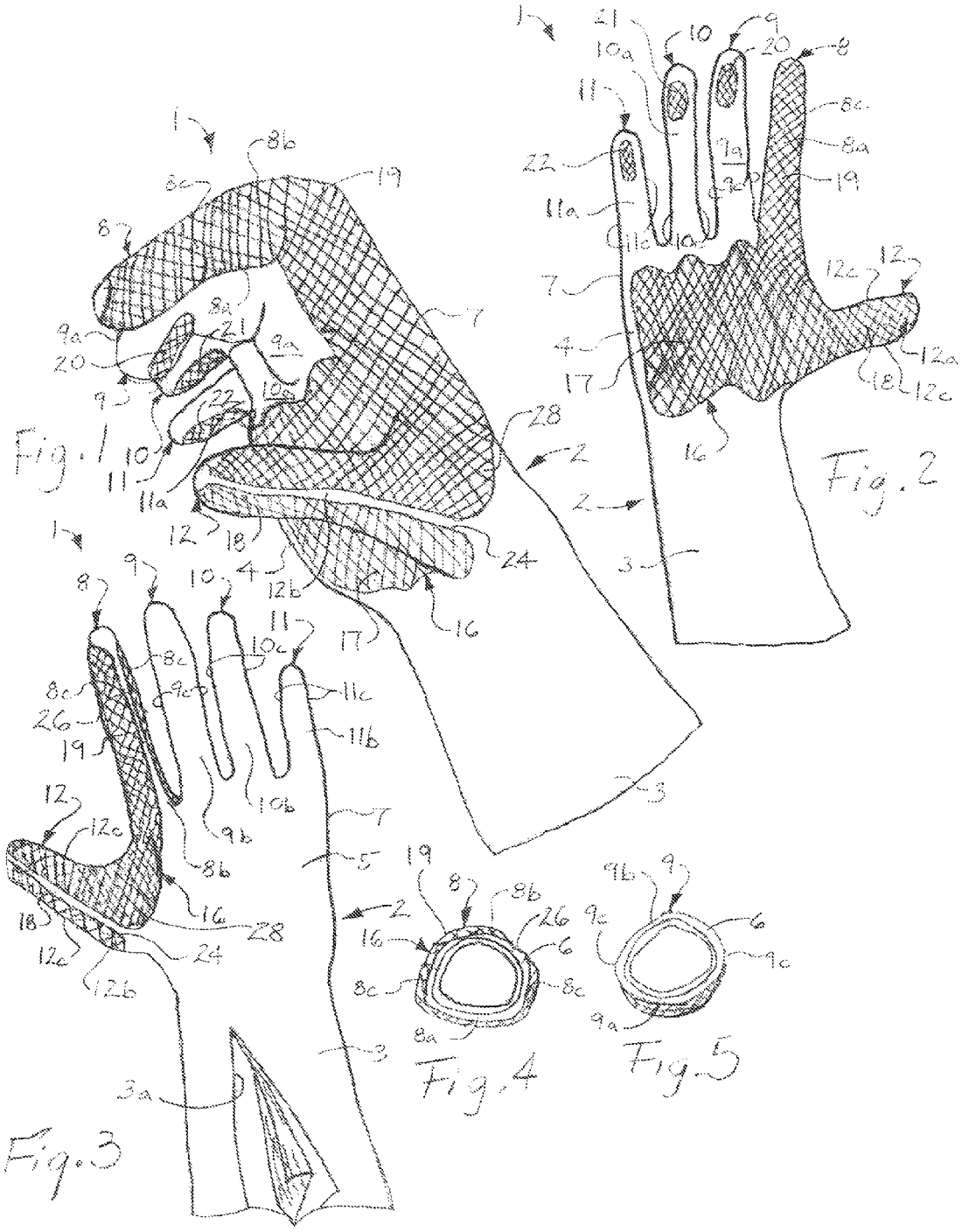
FIG. 1 is a side perspective view of an illustrative embodiment of a puncture-resistant glove.
FIG. 2 is a palm side surface view of an illustrative embodiment of the puncture-resistant glove.
FIG. 3 is a back hand surface view of an illustrative embodiment of the puncture-resistant glove.
FIG. 4 is a cross-sectional view of an index finger of an illustrative embodiment of the puncture-resistant glove.
FIG. 5 is a cross-sectional view of a middle finger of an illustrative embodiment of the puncture-resistant glove.

The following detailed description is merely exemplary in nature and is not intended to limit the described embodiments or the application and uses of the described embodiments. As used herein, the word "exemplary" or "illustrative" means "serving as an example, instance, or illustrations." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Referring to the drawings, an illustrative embodiment of a puncture-resistant glove is generally indicated by reference numeral 1. In some applications, a pair of the puncture-resistant gloves 1 can be worn on the hands of a wearer (not illustrated) to protect the wearer's hands from being inadvertently cut, punctured or impaled while shucking oysters. However, the puncture-resistant glove 1 is equally amenable to any of a variety of alternative applications in which protection of the user's hands from a cutting, puncturing or impaling injury is desired. When used for the purpose of protecting the wearer's hand while shucking oysters, the puncture-resistant glove 1 may be a right-handed glove, as illustrated, for a right-handed wearer. The puncture-resistant glove 1 may be a left-handed glove for a left-handed wearer in oyster-shucking applications. The left-handed glove 1 may be a mirror image of the right-handed glove 1. A right-handed glove 1 may be worn on the right hand and a left-handed glove 1 may be worn on the left hand to protect both hands from a cutting, puncturing or impaling injury during shucking of oysters or other applications. The puncture-resistant gloves 1 may also be worn on the hands to thermally insulate and protect the hands from cold during the shucking of oysters.

The puncture-resistant glove 1 may include a glove body 2 having a glove body wall 6 (FIGS. 4 and 5) which in some embodiments may be rubber of selected thickness. In other embodiments, the glove body 2 may be alternative materials which are commonly used for the construction of gloves. In oyster-shucking applications, the glove body 2 may have a food service grade, all natural rubber construction. The glove body 2 may have a wrist portion 3 and a hand portion 7 which extends from the wrist portion 3. As illustrated in FIG. 3, in some embodiments, the wrist portion 3 of the glove body 2 may have a wrist portion slit 3*a* which enables expansion of the wrist portion 3 to facilitate placement of the puncture-resistant glove 1 on the hand (not illustrated) of a wearer. The hand portion 7 may include a palm side surface 4 (FIG. 2) and a backhand side surface 5 (FIG. 3). The hand portion 7 may further include an index finger 8, a middle finger 9, a ring finger 10, a little finger 11 and a thumb 12. The index finger 8 may have a palm side surface 8*a* (FIG. 2) which corresponds to the palm side 4 of the hand portion 7, a backhand surface 8*b* (FIG. 3) which corresponds to the backhand side 5 of the hand portion 7 and side surfaces 8*c* which extend from the palm side surface 8*a* to the backhand surface 8*b*. Similarly, the middle finger 9 may have a palm side surface 9*a*, a backhand surface 9*b* and side surfaces 9*c*; the ring finger 10 may have a palm side surface 10*a*, a backhand surface 10*b* and side surfaces 10*c*; the little finger 11 may have a palm side surface 11*a*, a backhand surface 11*b* and side surfaces 11*c*; and the thumb 12 may have a palm side surface 12*a*, a backhand surface 12*b* and side surfaces 12*c*.

The glove body 2 includes at least one puncture-resistant area 16 which is resistant to puncture or cutting by a blunt or sharp instrument such as a knife, for example and without limitation. The puncture-resistant area 16 may include a palm section 17 which substantially covers the palm side 4 of the hand portion 7. A thumb section 18 of the puncture-resistant area 16 may extend from the palm section 17 and substantially covers the palm side surface 12*a* of the thumb 12. The thumb section 18 may additionally extend or wrap around the side surfaces 12*c* and at least partially cover the backhand surface 12*b* of the thumb 12, as illustrated in FIGS. 1 and 3. In some embodiments, a thumb portion gap 24 may separate adjacent edges of the thumb section 18 of the puncture-resistant area 16 at the backhand surface 12*b* of the thumb 12, as further illustrated in FIGS. 1 and 3. Along and within the thumb portion gap 24, the backhand surface 12*b* of the thumb 12 may remain substantially exposed and uncovered by the puncture-resistant area 16.

An index finger section 19 may extend from the palm section 17 of the puncture-resistant area 16 and substantially covers the palm side surface 8*a* of the index finger 8. As illustrated in FIG. 4, the index finger section 19 may additionally extend or wrap around the side surfaces 8*c* and at least partially cover the backhand surface 8*b* of the index finger 8, as illustrated in FIG. 3. In some embodiments, an index finger portion gap 26 may separate adjacent edges of the index finger section 19 of the puncture-resistant area 16, as further illustrated in FIG. 3. Along and within the index finger portion gap 26, the backhand surface 8*b* of the index finger 8 may remain substantially exposed and uncovered by the puncture-resistant area 16. As illustrated in FIGS. 1 and 3, on the backhand side 5 of the hand portion 7, a bridge section 28 may connect the thumb section 18 to the index finger section 19 of the puncture-resistant area 16.

In some embodiments, the puncture-resistant area 16 may further include a middle finger section 20 on generally the distal one-third of the palm side surface 9*a* of the middle finger 9. The proximal two-thirds of the palm side surface 9*a* of the middle finger 9 may remain completely or substantially exposed and uncovered by the puncture-resistant area 16. As illustrated in FIGS. 3 and 5, the backhand surface 9*b* and the side surfaces 9*c* of the middle finger 9 may remain completely or substantially exposed and uncovered by the puncture-resistant area 16. In other embodiments the middle finger section 20 may be omitted from the palm side surface 9*a* of the middle finger 9.

In some embodiments, the puncture-resistant area 16 may further include a ring finger section 21 on generally the distal one-third of the palm side surface 10*a* of the ring finger 10. The proximal two-thirds of the palm side surface 10*a* of the ring finger 10 may remain completely or substantially exposed and uncovered by the puncture-resistant area 16. As illustrated in FIG. 3, the backhand surface 10*b* and the side surfaces 10*c* of the ring finger 10 may remain completely or substantially exposed and uncovered by the puncture-resistant area 16. In other embodiments, the ring finger section 21 may be omitted from the palm side surface 10*a* of the ring finger 10.

In some embodiments, the puncture-resistant area 16 may further include a little finger section 22 on generally the distal one-third of the palm side surface 11*a* of the little finger 11. The proximal two-thirds of the palm side surface 11*a* of the little finger 11 may remain completely or substantially exposed and uncovered by the puncture-resistant area 16. As illustrated in FIG. 3, the backhand surface 11*b* and the side surfaces 11*c* of the little finger 11 may remain completely or substantially exposed and uncovered by the puncture-resistant area 16. In other embodiments, the little finger section 22 may be omitted from the palm side surface 11*a* in of the little finger 11.

In some embodiments, the glove body wall 6 of the glove body 2 may be rubber and the puncture-resistant area 16 may be formed using a rubber vulcanization process which may be conventional. In other embodiments, the puncture-resistant area 16 may be formed by attaching one or multiple layered patches (not illustrated) of a puncture-resistant material to the exterior surface of the glove body wall 6 using sewing or other physical and/or chemical attachment techniques which are known by those skilled in the art. The puncture-resistant patch or patches may be initially cut to the size and shape of the puncture-resistant area 16 prior to application of the patch or patches to the glove body 2. Puncture-resistant materials which may be suitable for the puncture-resistant area 16 include but are not limited to fibers including polyolefin, polyvinyl alcohol, polyacrylonitrile, polyester and polyamide materials. Continuous filament yarns, staple filament yarns or a combination of continuous filament yarns and staple filament yarns may be suitable for the purpose. The puncture-resistant area 16 may include one or multiple layers of puncture-resistant material of the same type or different types. In some embodiments, the puncture-resistant area 16 may include alternating layers of puncture-resistant material of different types.

In exemplary application, a left-handed and right-handed pair of the puncture-resistant gloves 1 is donned on the left hand and the right hand, respectively, of a wearer to protect the wearer's hands from being inadvertently cut, punctured or impaled by a knife (not illustrated) as the wearer shucks oysters (not shown). The puncture-resistant gloves 1 additionally thermally insulate the wearer's hands from cold during shucking. Accordingly, the right-handed puncture-resistant glove 1 is worn on the right hand of the wearer whereas the left-handed puncture-resistant glove 1 is worn on the left hand of the wearer during shucking. The wearer grasps the oyster with one hand and grasps a knife (not illustrated) with the opposite hand.

The blade of the knife is initially inserted between the top and bottom portions of the oyster shell (not illustrated) next to the hinge which connects the top and bottom shell portions of the oyster shell. The top shell portion is cut from the bottom shell portion as the inserted knife is moved from one side to the other side of the hinge. The top shell portion is then cut, broken or otherwise separated from the bottom shell portion and discarded, after which the oyster may then be cut free from the bottom shell portion and eaten broiled, baked, fried or raw. Alternatively, the oyster may be placed back on the bottom shell portion and served other similarly-prepared oysters to a consumer as oysters on the half shell or may be seasoned and baked or broiled and served as Oysters Rockefeller or Oysters Bienville.

It will be appreciated by those skilled in art that the puncture-resistant area 16 on the glove body 2 of each puncture-resistant glove 1 covers the regions or areas on the glove body 2 which correspond to the portions of the wearer's hands which are most vulnerable to being cut, punctured or impaled should the blade of the knife inadvertently slip from between the shell portions of the oyster shell during the shucking operation. Accordingly, the puncture-resistant area 16 prevents the knife from inadvertently puncturing the glove body 2 and cutting, puncturing or impaling the hand of the wearer which holds the oyster. Additionally, the puncture-resistant area 16 prevents fragmented portions of the oyster shell from cutting the wearer's hands and additionally protects the hand of the wearer which holds the knife. Moreover, the areas on the surface of the glove body 2 which remain exposed and uncovered by the puncture-resistant area 16 may maintain sufficient flexibility to enable the wearer of the puncture-resistant glove 1 to securely hold the oyster during the shucking operation. The puncture-resistant gloves 1 additionally thermally insulate the wearer's hands from cold during shucking. After the oyster-shucking operation is completed, the wearer may remove the puncture-resistant gloves 1 from the wearer's hands and discard or clean the puncture-resistant gloves 1 for subsequent use.

While the illustrative embodiments of the disclosure have been described above, it will be recognized and understood that various modifications can be made in the disclosure and the appended claims are intended to cover all such modifications which may fall within the spirit and scope of the disclosure.

What is claimed is:

1. A puncture-resistant glove, comprising:

a glove body including a hand portion having a palm side surface, a backhand side surface, an index finger with an index finger palm side surface corresponding to said palm side surface of said hand portion, an index finger backhand side surface corresponding to said backhand side surface of said hand portion, index finger side surfaces extending from said index finger palm side surface to said index finger backhand side surface, and an index finger end; a middle finger with a middle finger palm side surface corresponding to said palm side surface of said hand portion, a middle finger backhand side surface corresponding to said backhand side surface of said hand portion, middle finger side surfaces extending from said middle finger palm side surface to said middle finger backhand side surface, and a middle finger end; a ring finger with a ring finger palm side surface corresponding to said palm side surface of said hand portion, a ring finger backhand side surface corresponding to said backhand side surface of said hand portion, ring finger side surfaces extending from said ring finger palm side surface to said ring finger backhand side surface, and a ring finger end; a little finger with a little finger palm side surface corresponding to said palm side surface of said hand portion, a little finger backhand side surface corresponding to said backhand side surface of said hand portion, little finger side surfaces extending from said little finger palm side surface to said little finger backhand side surface, and a little finger end; and a thumb with a thumb palm side surface corresponding to said palm side surface of said hand portion, a thumb backhand side surface corresponding to said backhand side surface of said hand portion, thumb side surfaces extending from said thumb palm side surface to said thumb backhand side surface, and a thumb end;

a puncture-resistant area including:

a palm section covering said palm side surface of said hand portion;

an index finger section covering said index finger palm side surface and said index finger side surfaces and substantially covering said index finger backhand side surface up to but not including said index finger end of said index finger;

a middle finger section generally covering and limited to a distal one-third of said middle finger palm side surface of said middle finger;

a ring finger section generally covering and limited to a distal one-third of said ring finger palm side surface of said ring finger;

a little finger section generally covering and limited to a distal one-third of said little finger palm side surface of said little finger; and a thumb section covering said thumb palm side surface and said thumb side surfaces and substantially covering said thumb backhand side surface up to but not including said thumb end of said thumb.

2. The puncture-resistant glove of claim 1 wherein said puncture-resistant area comprises vulcanized rubber.

3. The puncture-resistant glove of claim 1 further comprising a thumb section gap between adjacent edges of said puncture-resistant area on a back hand surface of said thumb.

4. The puncture-resistant glove of claim 1 further comprising an index finger section gap between adjacent edges of said puncture-resistant area on a back hand surface of said index finger.

5. A puncture-resistant glove, comprising:

a glove body including a hand portion having a palm side surface, a backhand side surface, an index finger with an index finger palm side surface corresponding to said palm side surface of said hand portion, an index finger backhand side surface corresponding to said backhand side surface of said hand portion, index finger side surfaces extending from said index finger palm side surface to said index finger backhand side surface, and an index finger end; a middle finger with a middle finger palm side surface corresponding to said palm side surface of said hand portion, a middle finger backhand side surface corresponding to said backhand side surface of said hand portion, middle finger side surfaces extending from said middle finger palm side surface to said middle finger backhand side surface, and a middle finger end; a ring finger with a ring finger palm side surface corresponding to said palm side surface of said hand portion, a ring finger backhand side surface corresponding to said backhand side surface of said hand portion, ring finger side surfaces extending from said ring finger palm side surface to said ring finger backhand side surface, and a ring finger end; a little finger with a little finger palm side surface corresponding to said palm side surface of said hand portion, a little finger backhand side surface corresponding to said backhand side surface of said hand portion, little finger side surfaces extending from said little finger palm side surface to said little finger backhand side surface, and a little finger end; and a thumb with a thumb palm side surface corresponding to said palm side surface of said hand portion, a thumb backhand side surface corresponding to said backhand side surface of said hand portion, thumb side surfaces extending from said thumb palm side surface to said thumb backhand side surface, and a thumb end; and a puncture-resistant area including:

a palm section generally covering said palm side surface of said hand portion;

a thumb section covering said thumb palm side surface and side thumb side surfaces and substantially covering said thumb backhand side surface up to but not including said thumb end of said thumb;

an index finger section covering said index finger palm side surface and said index finger side surfaces and substantially covering said index finger backhand side surface up to but not including said index finger end of said index finger;

a middle finger section generally covering and limited to a distal one-third of said middle finger palm side surface of said middle finger up to but not including said middle finger end of said middle finger;

a ring finger section generally covering and limited to a distal one-third of said ring finger palm side surface of said ring finger up to but not including said ring finger end of said ring finger; and a little finger section generally covering and limited to a distal one-third of said little finger palm side surface of said little finger up to but not including said little finger end of said little finger.

6. The puncture-resistant glove of claim 5 further comprising a bridge section connecting said thumb section to said index finger section of said puncture-resistant area on said palm side surface of said hand portion.

7. The puncture-resistant glove of claim 5 wherein said puncture-resistant area comprises vulcanized rubber.

8. The puncture-resistant glove of claim 5 further comprising a thumb section gap between adjacent edges of said thumb section of said puncture-resistant area on said thumb back hand side surface of said thumb.

9. The puncture-resistant glove of claim 5 further comprising an index finger section gap between adjacent edges of said index finger section of said puncture-resistant area on said index finger back hand side surface of said index finger.

* * * * *